US010925141B2

(12) United States Patent
Tang

(10) Patent No.: US 10,925,141 B2
(45) Date of Patent: Feb. 16, 2021

(54) LIGHTING DEVICE CONTROL SYSTEM COMPRISING A MATCHING MODULE AND AN RF MODULE AND USING A MATCHING CODE AND AN ACTIVATION CODE

(71) Applicant: Yi-Wen Tang, Taichung (TW)

(72) Inventor: Yi-Wen Tang, Taichung (TW)

( * ) Notice: Subject to any disclaimer, the term of this patent is extended or adjusted under 35 U.S.C. 154(b) by 27 days.

(21) Appl. No.: 16/230,429

(22) Filed: Dec. 21, 2018

(65) Prior Publication Data

US 2020/0205253 A1 Jun. 25, 2020

(51) Int. Cl.
*H05B 47/19* (2020.01)
*H05B 45/37* (2020.01)

(52) U.S. Cl.
CPC ..... *H05B 47/19* (2020.01); *H05B 45/37* (2020.01)

(58) Field of Classification Search
CPC ..... H05B 47/19; H05B 45/37
See application file for complete search history.

(56) References Cited

U.S. PATENT DOCUMENTS 10,630,820 B2 * 4/2020 Bora ..... H04W 4/06
2016/0254864 A1 * 9/2016 Mueller ..... H04B 10/116 398/118
2016/0330042 A1 * 11/2016 Andersen ..... G05B 15/02
2018/0248623 A1 * 8/2018 Ryan ..... H04B 10/116

* cited by examiner

*Primary Examiner* — Borna Alaeddini
(74) *Attorney, Agent, or Firm* — Muncy, Geissler, Olds & Lowe, P.C.

(57) ABSTRACT

A lighting device control system includes plural lighting assemblies having RF modules. When the RF module of one of the lighting assemblies is switched on to send an activation signal, the RF module of an other lighting assembly received the activation signal is switched on in order to control plural lighting assemblies the same time.

19 Claims, 5 Drawing Sheets

LIGHTING DEVICE CONTROL SYSTEM COMPRISING A MATCHING MODULE AND AN RF MODULE AND USING A MATCHING CODE AND AN ACTIVATION CODE

BACKGROUND OF THE INVENTION

Field of the Invention

The present invention relates to a lighting device control system.

Description of the Prior Art

Conventional lighting devices at home such as entrance lamp or interior lamp light on only when the user switches them on. To switch on easily, sensors are arranged on the lighting devices. However, the sensors cost too much, and the lighting devices cannot be switched on when the sensors are broken.

Besides, to switch plural lighting devices on at the same time, an assembly of lighting devices matched by infrared is provided. However, the lighting devices are already matched to be impossible to replace. For example, newly bought lighting device cannot be matched with the existed lighting devices. As a result, all the lighting devices have to be replaced by another assembly of lighting devices.

SUMMARY OF THE INVENTION

The main object of the present invention is to provide a lighting device control system to make the lighting assemblies having RF modules match with each other in order to control the lighting assemblies at the same time.

To achieve the above and other objects, the lighting device control device of the present invention includes at least two lighting assemblies. Each of the lighting assemblies includes a lighting device, a control unit, a first matching module, and a first RF (radio frequency) module. The first matching modules of any two of the lighting assemblies selectively match with each other to generate a matching code and to switch into a matching mode. When the control unit of one of the lighting assemblies which is on the matching mode switches the lighting device on, the first RF module of the lighting assembly sends an activation signal having the matching code. When the first RF module of one of other lighting assemblies which are on the matching mode receives the activation signal, the first matching module of the lighting assembly verifies the activation signal. The control unit of the lighting assembly switches the lighting device on when the activation signal is verified.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
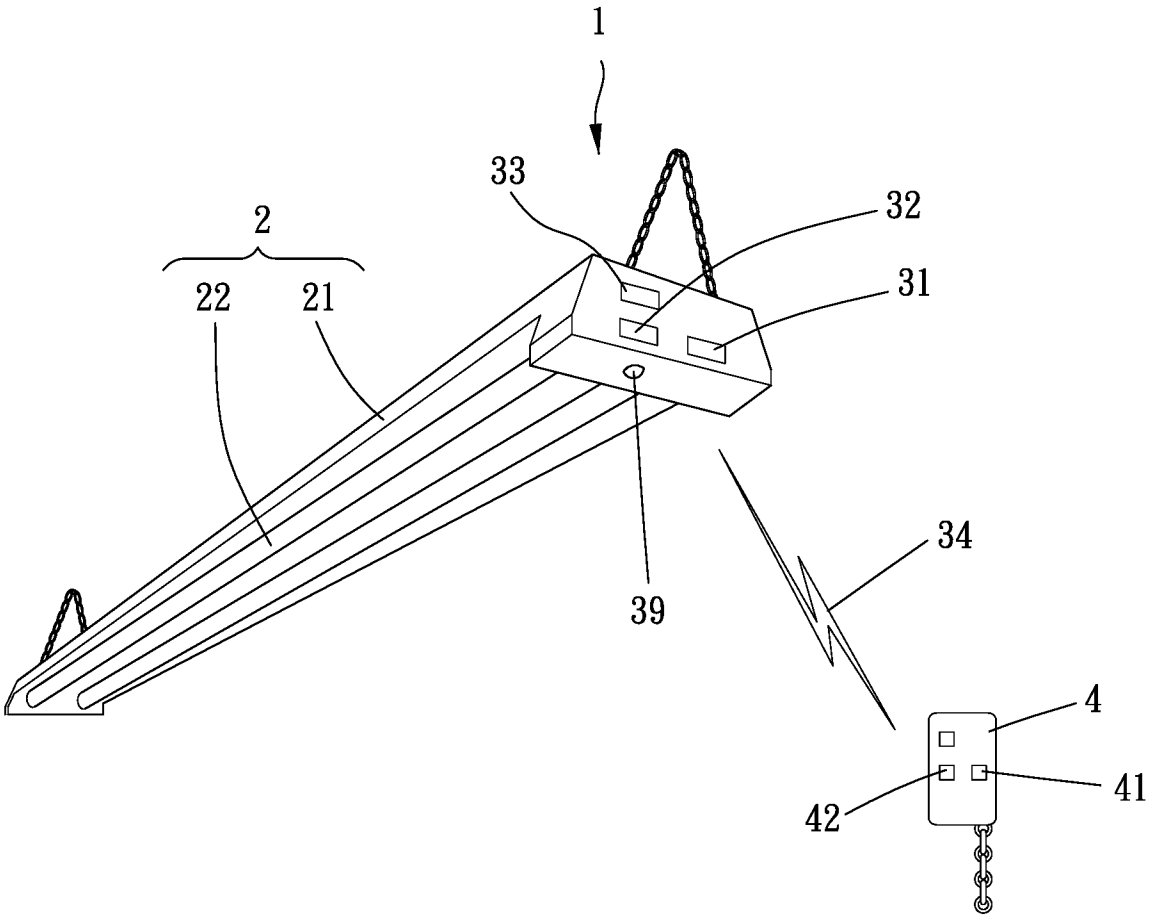
FIG. 1 and FIG. 2 are stereograms of the present invention.
Figure 2:
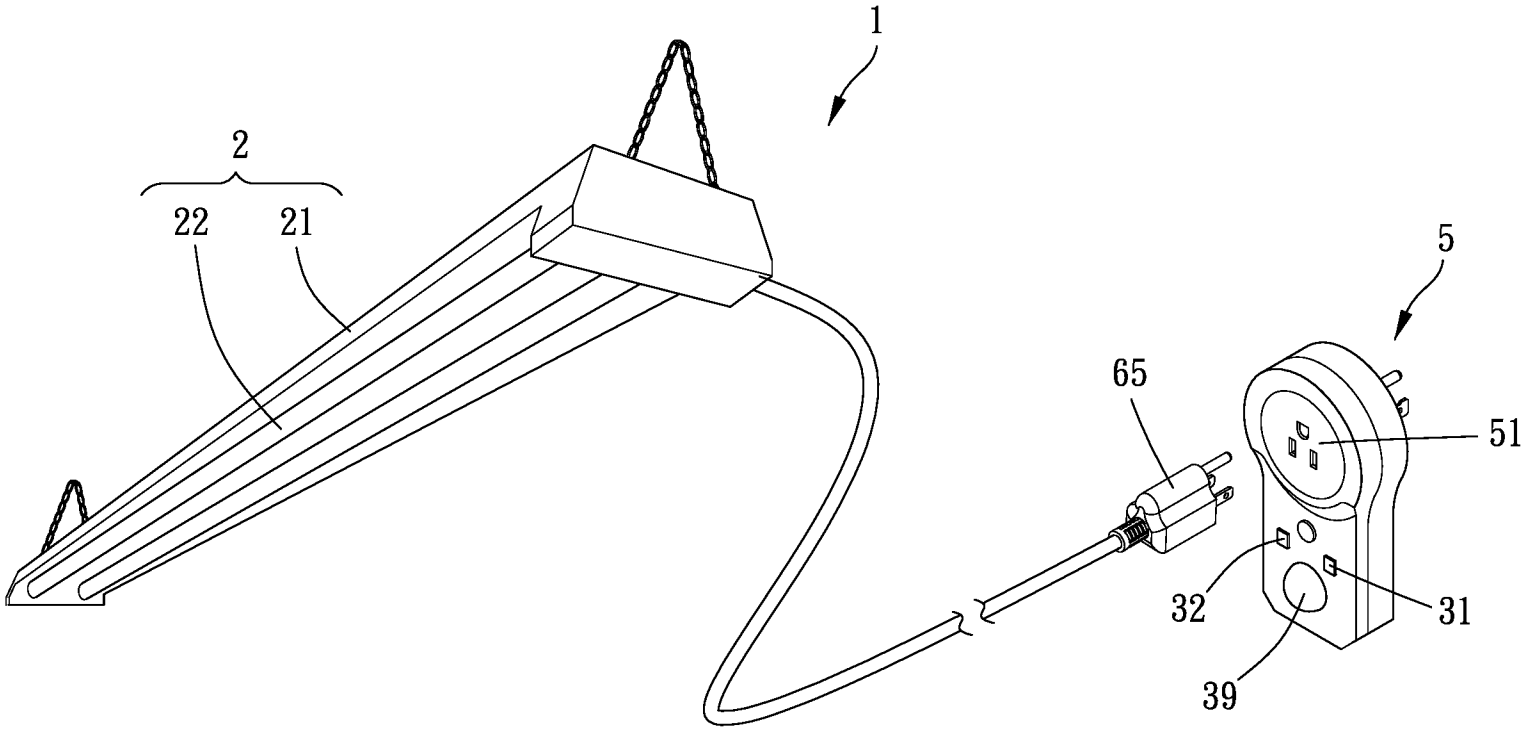
Figure 3:
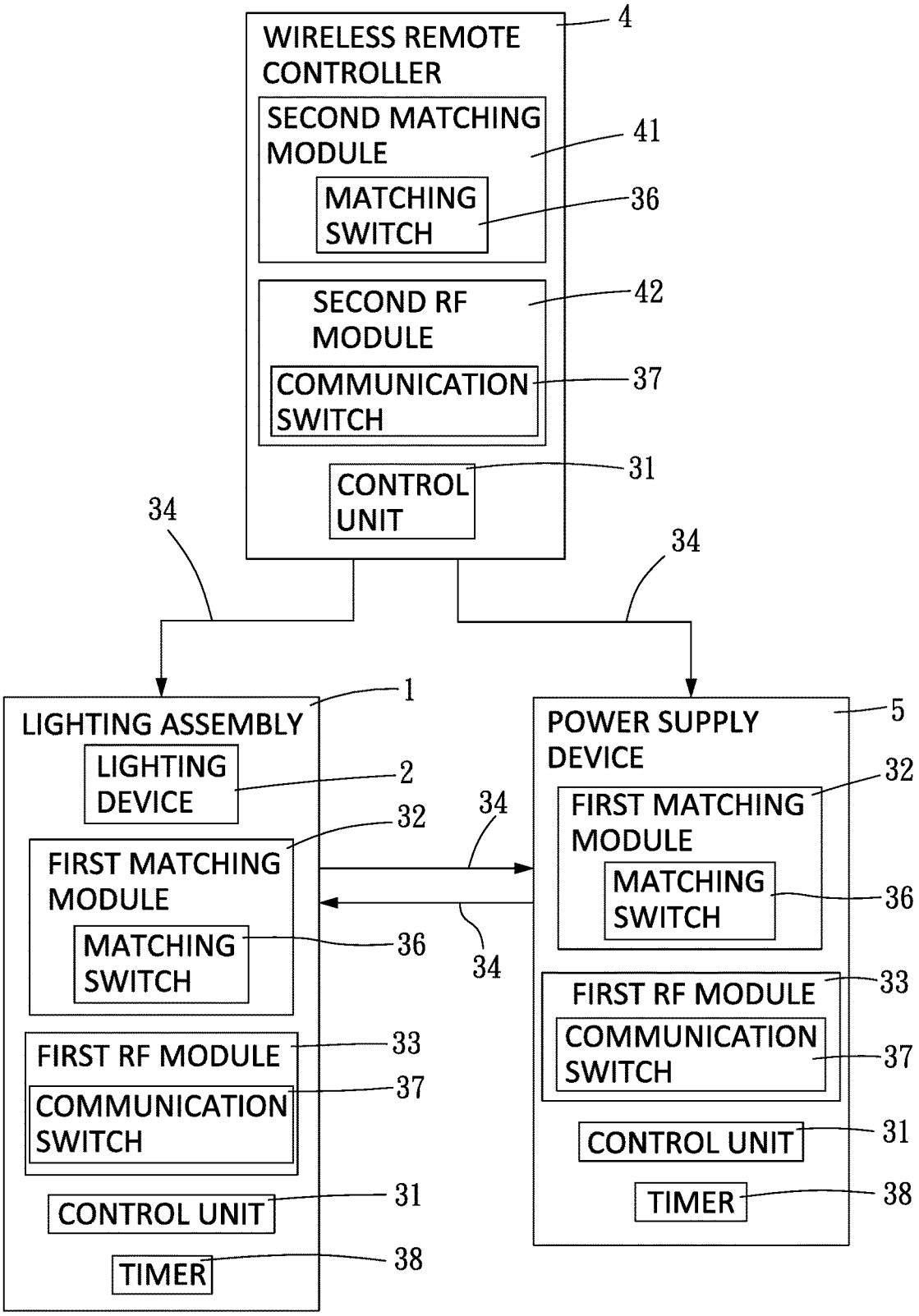
FIG. 3 is a system illustration of the present invention.

Please refer to FIG. 1 to FIG. 5, the lighting device control system of the present invention includes at least two lighting assemblies 1 (preferably at least three lighting assemblies 1). Each of the lighting assemblies 1 includes a lighting device 2, a control unit 31, a first matching module 32, and a first RF (radio frequency) module 33. The first matching modules 32 of any two of the lighting assemblies 1 selectively match with each other to generate a matching code and to switch into a matching mode. The first matching module 32 of an other lighting assembly 1 selectively matches with one of the first matching modules 32 on the matching mode to acquire the matching code to switch into the matching mode. Thereby, newly bought lighting assembly 1 can match with original lighting assemblies 1 which are on the matching mode for integrating all the lighting assemblies 1.

When the control unit 31 of one of the lighting assemblies 1 which is on the matching mode switches the lighting device 2 on, the first RF module 33 of the lighting assembly 1 sends an activation signal 34 having the matching code. When the first RF module 33 of one of other lighting assemblies 1 which are on the matching mode receives the activation signal 34, the first matching module 32 of the lighting assembly 1 verifies the activation signal 34. The control unit 31 of the lighting assembly 1 switches the lighting device 2 on when the activation signal 34 is verified. Thereby, the user just has to switch one of the lighting assemblies 1 on, and the lighting assembly 1 further sends the activation signal 34 to switch other lighting assemblies 1 on.

Preferably, a wireless remote controller 4 is further included. The wireless remote controller 4 includes a second matching module 41 and a second RF (radio frequency) module 42. The second matching module 41 selectively matches with one of the first matching modules 32 on the matching mode to acquire the matching code and to switch into the matching mode. The second RF module 42 of the wireless remote controller 4 on the matching mode becomes able to send the activation signal 34 having the matching code. Alternatively, the second matching module 41 selectively matches with a first matching module 32 which is not switched into the matching mode to generate a matching code and to switch into the matching mode. The second RF module 42 of the wireless remote controller 4 on the matching mode becomes able to send the activation signal 34 having the matching code. The user can make the wireless remote controller 4 join the existed matching group or create a new matching group.

Practically, each of the lighting devices 2 includes a seat 21 and a lighting member 22. The lighting member 22 is disposed on the seat 21. In the present embodiment, the lighting device 2 is a bar-type lamp. The lighting member 22 is electrically connected to the control unit 31.

Specifically, at least one of the lighting assemblies 1 further includes a power supply device 5. The power supply device 5 has the first matching module 32, the first RF module 33, and the control unit 31. The power supply device 5 is electrically connected to a power supply and the lighting member 22. More specifically, the power supply device 5 has a power supply socket 51. The lighting device 2 further has a plug 35 for connecting with the power supply socket 51. Thereby, the power supply device 5 is adapted for conventional lamps without matching module and RF module to match with the lighting device control system.

Preferably, each of the first matching modules 32 and the second matching module 41 has a matching switch 36. The matching switch 36 is adapted for controlling whether each of the first matching modules 32 and the second matching module 41 is able to switch into the matching mode or not and for cancelling the matching mode of each of the first matching modules 32 and the second matching module 41. Thereby, new lighting assembly 1 or the wireless remote controller 4 can be easily matched or canceled for matching. In other possible embodiments, only each of the first matching modules 32 has the matching switch 36.

Besides, each of the first RF modules 33 and the second RF module 42 has a communication switch 37. When the communication switch 37 is on, each of the first RF modules 33 and the second RF module 42 is able to operate. When the communication switch 37 is off, each of the first RF modules 33 and the second RF module 42 is prohibited from operating. Thereby, the lighting assemblies 1 and the power supply device 5 which are not to use may not be switched on.

Preferably, part of the lighting assemblies 1 and the power supply devices 5 has a timer 38. When the lighting assembly 1 having the timer 38 is switched on, the timer 38 switches off the lighting assembly 1 or the power supply device 5 after a period of time to save the energy. The lighting assembly 1 with the timer 38 can be used at the entrance or the garage.

Part of the lighting assemblies 1 has a sensor 39. When the lighting assembly 1 having the sensor 39 receives a sensing signal, the lighting assembly 1 is switched on and sends the activation signal 34 having the matching code. The sensor 39 can be an infrared sensor or others. When a person passes by, the lighting assembly 1 is automatically switched on.

Figure 4:
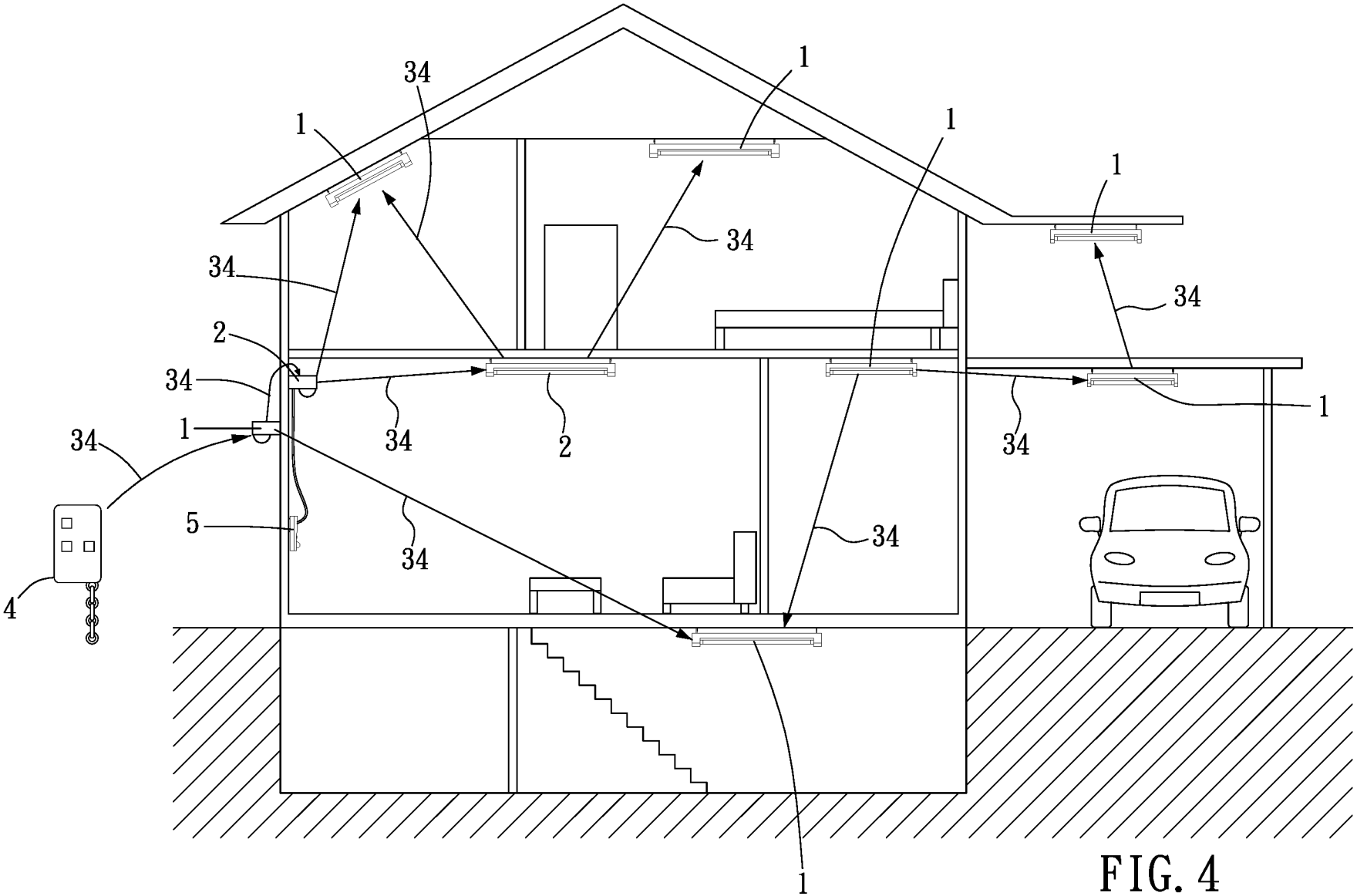
FIG. 4 is an illustration of the present invention.
Figure 5:
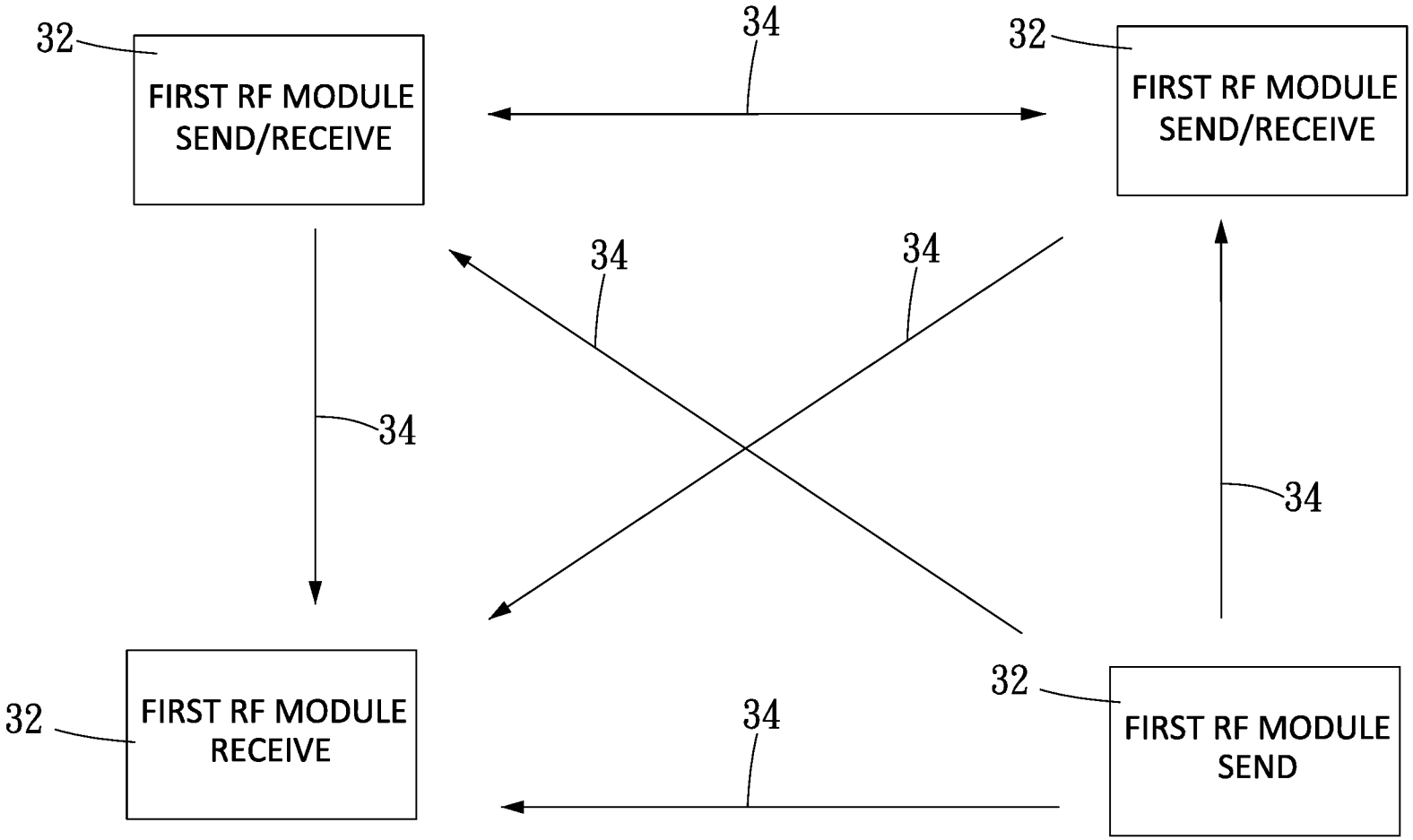
FIG. 5 is a flow chart of the present invention.

Furthermore, as shown in FIG. 4 and FIG. 5, part of the first RF modules 33 is able to send and receive the activation signal 34. Part of the first RF modules 33 is able to receive but unable to send the activation signal 34. Part of the first RF modules 33 is able to send but unable to receive the activation signal 34. For example, the lighting assembly 1 at the entrance is able to only send the activation signal 34. When the user comes home and switches the lighting assembly 1 at the entrance on, the lighting assembly 1 at the entrance sends the activation signal 34. The lighting assemblies 1 at the living room or the kitchen are able to send and receive the activation signal 34 so as to be switched on when receiving the activation signal 34. Other lighting assemblies 1 can be switched on when receiving the activation signal 34 from the lighting assemblies at the living room or the kitchen. Thereby, the user can switch on all the lighting assemblies 1 at the same time easily. Besides, the lighting assemblies 1 at the bedroom are less used, so the lighting assemblies 1 don't have to receive the activation signal 34 to prevent them from being switched on when other lighting assemblies 1 are switched on. When the user gets up in the morning and switches the lighting assembly 1 on, the lighting assemblies 1 at other places can be switched on too. However, the lighting assembly 1 at the entrance may not be switched on so that the energy can be saved.

In conclusion, the lighting device control system of the present invention has lighting assemblies having RF modules to match with each other. Thus, when one of the lighting assemblies is switched on, other lighting assemblies can be switched on too by receiving the activation signal from the lighting assembly which is switched on first. Thereby, the lighting assemblies can be switched on at the same time even if they are not electrically connected directly.

What is claimed is:

1. A lighting device control system includes:

at least two lighting assemblies, each of the lighting assemblies including a lighting device, a control unit, a first matching module, and a first RF (radio frequency) module, the first matching modules of any two of the lighting assemblies selectively matching with each other to generate a matching code and to switch into a matching mode;

when the control unit of one of the lighting assemblies which is on the matching mode switches the lighting device on, the first RF module of the lighting assembly sending an activation signal having the matching code;

when the first RF module of one of other lighting assemblies which are on the matching mode receives the activation signal, the first matching module of the lighting assembly verifying the activation signal, the control unit of the lighting assembly switching the lighting device on when the activation signal is verified.

2. The lighting device control system of claim 1, including at least three said lighting assemblies, the first matching modules of two of the lighting assemblies selectively matching with each other to generate the matching code and to switch into the matching mode, the first matching module of an other lighting assembly selectively matching with one of the first matching modules on the matching mode to acquire the matching code to switch into the matching mode.

3. The lighting device control system of claim 1, further including a wireless remote controller, the wireless remote controller including a second matching module and a second RF (radio frequency) module, the second matching module selectively matching with one of the first matching modules on the matching mode to acquire the matching code and to switch into the matching mode, the second RF module of the wireless remote controller on the matching mode becoming able to send the activation signal having the matching code.

4. The lighting device control system of claim 1, further including a wireless remote controller, the wireless remote controller including a second matching module and a second RF (radio frequency) module, the second matching module selectively matching with a first matching module which is not switched into the matching mode to generate a matching code and to switch into the matching mode, the second RF module of the wireless remote controller on the matching mode becoming able to send the activation signal having the matching code.

5. The lighting device control system of claim 3, wherein each of the lighting devices includes a seat and a lighting member, the lighting member is disposed on the seat, the lighting member is electrically connected to the control unit, at least one of the lighting assemblies further includes a power supply device, the power supply device has the first matching module, the first RF module, and the control unit, the power supply device is electrically connected to a power supply and the lighting member.

6. The lighting device control system of claim 5, wherein the power supply device has a power supply socket, the lighting device further has a plug for connecting with the power supply socket.

7. The lighting device control system of claim 6, wherein each of the first matching modules and the second matching module has a matching switch, the matching switch is adapted for controlling whether each of the first matching modules and the second matching module is able to switch into the matching mode or not and for cancelling the matching mode of each of the first matching modules and the second matching module.

8. The lighting device control system of claim 6, wherein each of the first RF modules and the second RF module has a communication switch, each of the first RF modules and the second RF module is able to operate when the communication switch is on, each of the first RF modules and the second RF module is prohibited from operating when the communication switch is off.

9. The lighting device control system of claim 1, wherein each of the first matching modules has a matching switch, the matching switch is adapted for controlling whether each of the first matching modules is able to switch into the matching mode or not and for cancelling the matching mode of each of the first matching modules.

10. The lighting device control system of claim 6, wherein part of the lighting assemblies and the power supply devices has a timer, when the lighting assembly having the timer is switched on, the timer switches off the lighting assembly or the power supply device after a period of time.

11. The lighting device control system of claim 1, wherein part of the lighting assemblies has a sensor, when the lighting assembly having the sensor receives a sensing signal, the lighting assembly is switched on and sends the activation signal having the matching code.

12. The lighting device control system of claim 1, wherein part of the first RF modules is able to send and receive the activation signal, part of the first RF modules is able to receive but unable to send the activation signal, part of the first RF modules is able to send but unable to receive the activation signal.

13. The lighting device control system of claim 7, wherein each of the lighting devices is a bar-type lamp; each of the first RF modules and the second RF module has a communication switch, each of the first RF modules and the second RF module is able to operate when the communication switch is on, each of the first RF modules and the second RF module is prohibited from operating when the communication switch is off; part of the lighting assemblies and the power supply devices has a timer, when the lighting assembly having the timer is switched on, the timer switches off the lighting assembly or the power supply device after a period of time; part of the lighting assemblies has a sensor, when the lighting assembly having the sensor receives a sensing signal, the lighting assembly is switched on and sends the activation signal having the matching code; part of the first RF modules is able to send and receive the activation signal, part of the first RF modules is able to receive but unable to send the activation signal, part of the first RF modules is able to send but unable to receive the activation signal.

14. The lighting device control system of claim 4, wherein each of the lighting devices includes a seat and a lighting member, the lighting member is disposed on the seat, the lighting member is electrically connected to the control unit, at least one of the lighting assemblies further includes a power supply device, the power supply device has the first matching module, the first RF module, and the control unit, the power supply device is electrically connected to a power supply and the lighting member.

15. The lighting device control system of claim 14, wherein the power supply device has a power supply socket, the lighting member further has a plug for connecting with the power supply socket.

16. The lighting device control system of claim 15, wherein each of the first matching modules and the second matching module has a matching switch, the matching switch is adapted for controlling whether each of the first matching modules and the second matching module is able to switch into the matching mode or not and for cancelling the matching mode of each of the first matching modules and the second matching module.

17. The lighting device control system of claim 15, wherein each of the first RF modules and the second RF module has a communication switch, each of the first RF modules and the second RF module is able to operate when the communication switch is on, each of the first RF modules and the second RF module is prohibited from operating when the communication switch is off.

18. The lighting device control system of claim 15, wherein part of the lighting assemblies and the power supply devices has a timer, when the lighting assembly having the timer is switched on, the timer switches off the lighting assembly or the power supply device after a period of time.

19. The lighting device control system of claim 16, wherein each of the lighting devices is a bar-type lamp; each of the first RF modules and the second RF module has a communication switch, each of the first RF modules and the second RF module is able to operate when the communication switch is on, each of the first RF modules and the second RF module is prohibited from operating when the communication switch is off; part of the lighting assemblies and the power supply devices has a timer, when the lighting assembly having the timer is switched on, the timer switches off the lighting assembly or the power supply device after a period of time; part of the lighting assemblies has a sensor, when the lighting assembly having the sensor receives a sensing signal, the lighting assembly is switched on and sends the activation signal having the matching code; part of the first RF modules is able to send and receive the activation signal, part of the first RF modules is able to receive but unable to send the activation signal, part of the first RF modules is able to send but unable to receive the activation signal.

* * * * *